US007311498B2

(12) United States Patent
Cunha et al.

(10) Patent No.: US 7,311,498 B2
(45) Date of Patent: Dec. 25, 2007

(54) MICROCIRCUIT COOLING FOR BLADES

(75) Inventors: Frank Cunha, Avon, CT (US); William Abdel-Messeh, Middletown, CT (US)

(73) Assignee: United Technologies Corporation, Hartford, CT (US)

( * ) Notice: Subject to any disclaimer, the term of this patent is extended or adjusted under 35 U.S.C. 154(b) by 154 days.

(21) Appl. No.: 11/286,793

(22) Filed: Nov. 23, 2005

(65) Prior Publication Data

US 2007/0116568 A1 May 24, 2007

(51) Int. Cl.
*F01D 5/14* (2006.01)

(52) U.S. Cl. ..... 416/97 R

(58) Field of Classification Search ..... 416/97 R
See application file for complete search history.

(56) References Cited

U.S. PATENT DOCUMENTS 6,254,334 B1 * 7/2001 LaFleur ..... 416/97 R

FOREIGN PATENT DOCUMENTS

| | | |
|---|---|---|
| EP | 1091091 | 4/2001 |
| EP | 1505257 | 2/2005 |
| JP | 2001-107704 | 4/2001 |

* cited by examiner

*Primary Examiner*—Richard Edgar
(74) *Attorney, Agent, or Firm*—Bachman & LaPointe

(57) ABSTRACT

A turbine engine component such as a turbine blade includes an airfoil portion formed by a suction side wall and a pressure side wall, and a cooling microcircuit incorporated in at least one of the suction side wall and the pressure side wall. The cooling microcircuit comprises a channel through which a cooling fluid flows, at least one exit hole for distributing cooling fluid over a surface of the turbine blade, and internal features within the channel for accelerating the flow of cooling fluid prior to the cooling fluid flowing through the at least one exit hole.

24 Claims, 1 Drawing Sheet

MICROCIRCUIT COOLING FOR BLADES

BACKGROUND OF THE INVENTION (1) Field of the Invention

The present invention relates to a plurality of internal features to be incorporated into a cooling microcircuit in a turbine engine component.

(2) Prior Art

A wide variety of cooling circuits have been used to generate a flow of cooling fluid over surfaces of turbine engine components. However, these cooling circuits have not been effective. These existing supercooling blade designs have film and internal cooling limitations. In general, these limitations lead to cracking in a relatively short period of hot operating time. Cracking occurs at the suction and pressure sides of the blade as depicted in these figures. Current cooling circuit exit slot configurations are also prone to limitations on film coverage. In some designs, film from the slots exits normal to the main hot gas path, and the slot exit areas is considerably reduced by coat-down.

Thus, there is needed a more effective cooling circuit.

SUMMARY OF THE INVENTION

In accordance with the present invention, there is provided a cooling microcircuit for use in turbine engine components, such as turbine blades, which convectively cools the blade with a high degree of convective efficiency (heat pick-up).

In accordance with the present invention, there is provided a cooling microcircuit for use in a turbine engine component. The cooling microcircuit broadly comprises a channel through which a cooling fluid flows, at least one exit hole for distributing cooling fluid over a surface of the turbine engine component, and means within the channel for accelerating the flow of cooling fluid prior to the cooling fluid flowing through the at least one exit hole.

Further in accordance with the present invention, there is provided a turbine blade for use in a turbine engine. The turbine blade broadly comprises an airfoil portion formed by a suction side wall and a pressure side wall, and a cooling microcircuit incorporated in at least one of the suction side wall and the pressure side wall. The cooling microcircuit comprises a channel through which a cooling fluid flows, at least one exit hole for distributing cooling fluid over a surface of the turbine blade, and means within the channel for accelerating the flow of cooling fluid prior to the cooling fluid flowing through the at least one exit hole.

Other details of the microcircuit cooling for blades of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
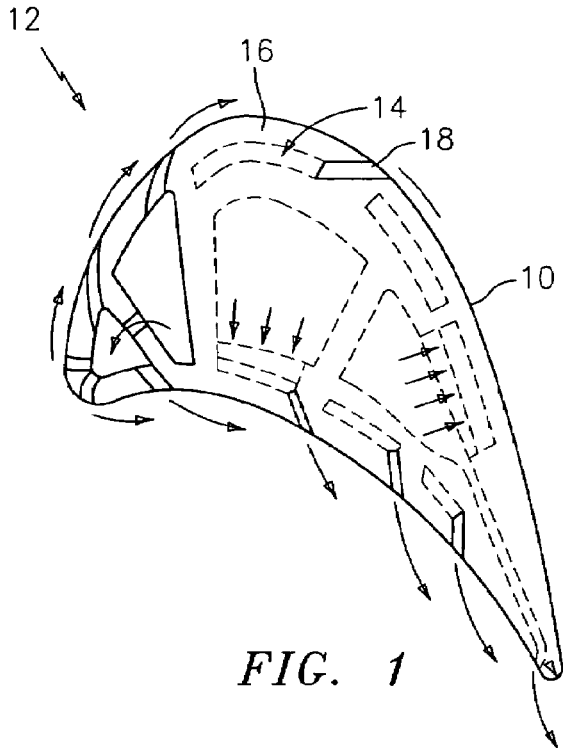
FIG. 1 illustrates an airfoil portion of a turbine engine component having a cooling microcircuit.

Referring now to the drawings, FIG. 1 illustrates an airfoil portion 10 of a turbine engine component 12, such as a turbine blade. Because of advances in refractory metal core technology, it is now possible to form a cooling microcircuit 14 in a wall 16 of the airfoil portion. The cooling microcircuit 14 may be used to convectively cool the blade with a high degree of convective efficiency (heat pick-up). Convective efficiency is a measure of heat pick-up by the coolant. Convective efficiency can be increased by a range of design parameters. These include: an increase in wet surface area, such as the perimeter of the cross-sectional area with high aspect ratio, and/or the internal heat transfer coefficient by means of internal features such as pedestals of various shapes (circular, elliptical, diamond-shaped, airfoil shaped, etc.).

One of the advantages associated with the use of refractory metal core technology is that the refractory metal core sheets may be formed to conform to the airfoil profile. This allows for forming the exit slots 18 for film cooling with high film coverage. In this way, the cooling film blanket will stay adjacent to the blade external wall providing a protective film cooling blanket and thus avoiding film blow-out and premature film decay.

Figure 2:
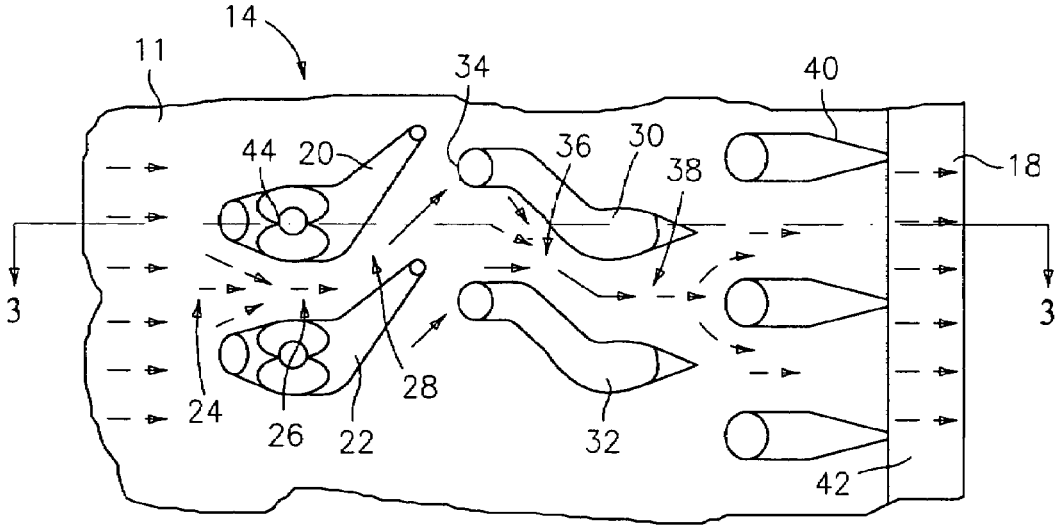
FIG. 2 is a schematic representation of a set of internal features to be incorporated into a cooling microcircuit.

FIG. 2 illustrates internal features which may be incorporated into the cooling flow channel 11 of a cooling microcircuit 14. These features have very important heat transfer attributes. The cooling flow channel 11 may be supplied with a flow of cooling fluid from any suitable source (not shown) via one or more inlets (not shown).

The internal features which may be incorporated into the cooling microcircuit 14 include a first set of internal features such as a pair of dog-legged pedestals 20 and 22. The pedestals 20 and 22 may be designed and aligned so that in a region 24, the flow of cooling fluid accelerates through the cooling circuit. For subsonic flow regimes with a Mach number less than unity, a decrease in flow area leads to an increase in flow velocity. As the cooling flow velocity increases in region 24, the heat transfer coefficient increases. As the flow accelerates and attains a maximum velocity, it is desirable to maintain that high velocity as long as possible. Therefore, the pedestals 20 and 22 are configured so as to form a region 26 for that effect. Region 28 formed by the pedestals 20 and 22 are used to take advantage of the pumping effects due to rotation of the turbine engine component, such as a turbine blade.

After exiting the region 28, the cooling fluid flow preferably encounters a second set of internal features, such as a pair of shaped pedestals 30 and 32. As the flow exiting the region 28 accelerates, it will impinge on the leading edge 34 of each of the pedestals 30 and 32. The heat transfer coefficient will increase as a function of the diameter of the leading edge 34. Small diameters will enhance the internal heat transfer coefficient.

The pedestals 30 and 32 are shaped and positioned to form a convergent section 36 where the area change decreases. This change forces the velocity to increase once again leading to high heat transfer coefficients. The pedestals 30 and 32 are shaped so as to provide a region 38 which is used to maintain high velocity and to straighten the flow before exiting to the next section in the cooling scheme.

The cooling microcircuit 14 can have many arrangements with the aforementioned internal features 20, 22, 30, and 32 being repeated in sequence axially along the length of the airfoil portion 10.

At the end of the cooling microcircuit 14, a series of internal features 40, usually teardrop shaped, can be placed to direct the cooling flow in such a manner as to provide an improved film cooling blanket along the exterior surface of the airfoil portion 10.

Figure 3:
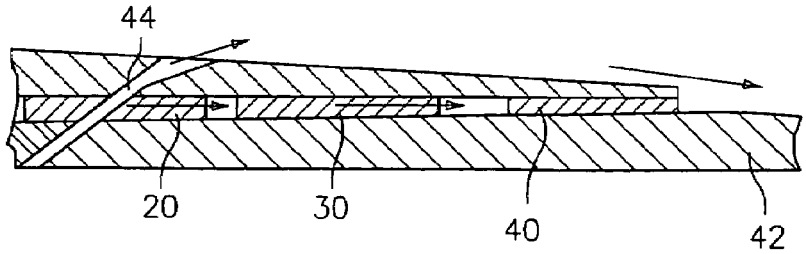
FIG. 3 is a sectional view of the cooling microcircuit taken along lines 3-3 in FIG. 2.

As shown in FIG. 3, at the end of the features 20, 22, 30, and 32, the trailing edge has a form of a wedge with two top and bottom angles within about 4 degrees from the axial direction. As described, film cooling will be adjacent to the surface of the turbine engine component 10 as it exits in region 42. This film cooling can be improved by introducing another film row out of a cooling hole 44 placed in each of the features 20 and 22. Each cooling hole 44 may be supplied with a flow of cooling fluid in any suitable manner such as from a blade inner air plenum. This allows for film superposition and convection cooling of the features 20 and 22 as each hole 44 may be machined right through the feature and the airfoil wall. This is particularly important for protecting the pressure side trailing edge from large thermal loads occurring in rotating blades.

The internal features described hereinbefore can be fabricated using a refractory metal core sheet which has been laser cut to have holes in the shapes of the internal features.

While the present invention has been described in the context of a single cooling microcircuit, it should be apparent to those skilled in the art that each cooling microcircuit formed in the walls of the airfoil portion 10 can utilize the internal features described hereinbefore.

While the present invention has been described in the context of a turbine blade, the cooling microcircuit could be used in other turbine engine components.

It is apparent that there has been provided in accordance with the present invention microcircuit cooling for blades which fully satisfies the objects, means, and advantages set forth hereinbefore. While the present invention has been described in the context of specific embodiments thereof, other unforeseeable alternatives, modifications, and variations may become apparent to those skilled in the art having read the foregoing description. Accordingly, it is intended to embrace such alternatives, modifications, and variations as fall within the broad scope of the appended claims.

What is claimed is:

1. A cooling microcircuit for use in a turbine engine component comprising:

a channel through which a cooling fluid flows;

at least one exit hole for distributing cooling fluid over a surface of said turbine engine component;

means within said channel for accelerating the flow of cooling fluid prior to said cooling fluid flowing through said at least one exit hole;

said accelerating means comprising a first set of internal features position within said channel and said first set of internal features being shaped and positioned relative to each other so as to create a first flow acceleration zone; and an additional row of film cooling holes for film superposition and convection cooling of the first set of internal features.

2. The cooling microcircuit of claim 1, wherein said first flow acceleration zone comprises a converging area created by said first set of internal features.

3. The cooling microcircuit of claim 1, wherein said first set of internal features create a region for maintaining cooling flow velocity.

4. The cooling microcircuit of claim 3, wherein said first set of internal features creates a region which takes advantage of pumping effects created by rotation of said turbine engine component.

5. The cooling microcircuit of claim 1, wherein said accelerating means comprises a second set of internal features positioned near a trailing edge portion of the first set of internal features.

6. The cooling microcircuit of claim 5, wherein said second set of internal features comprises at least a pair of internal features and each of said pair of internal features having a leading edge with a diameter which enhances an internal heat transfer coefficient.

7. The cooling microcircuit of claim 6, wherein said second set of internal features are shaped and positioned so as to create a convergent section adjacent said leading edges so as to accelerate the flow of cooling fluid.

8. The cooling microcircuit of claim 7, wherein said second set of internal features are shaped and positioned so as to create a zone adjacent said convergent section wherein velocity of the cooling fluid is maintained and the flow of cooling fluid is straightened.

9. The cooling microcircuit of claim 5, further comprising means for straightening the flow of cooling fluid before said cooling fluid exits through said at least one exit hole.

10. The cooling microcircuit of claim 9, wherein said straightening means comprises a plurality of teardrop shaped internal features.

11. The cooling microcircuit of claim 1, wherein said additional row of film cooling holes is formed by holes machined through each of said internal features.

12. A cooling microcircuit for use in a turbine engine component comprising:

a channel through which a cooling fluid flows;

at least one exit hole for distributing cooling fluid over a surface of said turbine engine component;

means within said channel for accelerating the flow of cooling fluid prior to said cooling fluid flowing through said at least one exit hole;

said accelerating means comprising a first set of internal features position within said channel and said first set of internal features being shaped and positioned relative to each other so as to create a first flow acceleration zone;

said first set of internal features creating a region for maintaining cooling flow velocity; and said first set of internal features creating a region which takes advantage of pumping effects created by rotation of said turbine engine component, wherein said first set of internal features comprises a pair of dog-legged internal features.

13. A turbine blade comprising:

an airfoil portion formed by a suction side wall and a pressure side wall;

a cooling microcircuit incorporated in at least one of the suction side wall and the pressure side wall;

said cooling microcircuit comprising a channel through which a cooling fluid flows, at least one exit hole for distributing cooling fluid over a surface of said turbine blade, and means within said channel for accelerating the flow of cooling fluid prior to said cooling fluid flowing through said at least one exit hole;

said accelerating means comprising a first set of internal features position within said channel and said first set of internal features being shaped and positioned relative to each other so as to create a first flow acceleration zone; and an additional row of film cooling holes for film superposition and convection cooling of the first set of internal features.

14. The turbine blade of claim 13, wherein said first flow acceleration zone comprises a converging area created by said first set of internal features.

15. The turbine blade of claim 13, wherein said first set of internal features create a region for maintaining cooling flow velocity.

16. The turbine blade of claim 15, wherein said first set of internal features creates a region which takes advantage of pumping effects created by rotation of said turbine blade.

17. The turbine blade of claim 13, wherein said accelerating means comprises a second set of internal features positioned near a trailing edge portion of the first set of internal features.

18. The turbine blade of claim 17, wherein said second set of internal features comprises at least a pair of internal features and each of said pair of internal features having a leading edge with a diameter which enhances an internal heat transfer coefficient.

19. The turbine blade of claim 18, wherein said second set of internal features are shaped and positioned so as to create a convergent section adjacent said leading edges so as to accelerate the flow of cooling fluid.

20. The turbine blade of claim 19, wherein said second set of internal features are shaped and positioned so as to create a zone adjacent said convergent section wherein velocity of the cooling fluid is maintained and the flow of cooling fluid is straightened.

21. The turbine blade of claim 17, further comprising means for straightening the flow of cooling fluid before said cooling fluid exits through said at least one exit hole.

22. The turbine blade of claim 21, wherein said straightening means comprises a plurality of teardrop shaped internal features.

23. The turbine blade of claim 13, wherein said additional row of film cooling holes is formed by holes machined through each of said internal features.

24. A turbine blade comprising:

an airfoil portion formed by a suction side wall and a pressure side wall;

a cooling microcircuit incorporated in at least one of the suction side wall and the pressure side wall;

said cooling microcircuit comprising a channel through which a cooling fluid flows, at least one exit hole for distributing cooling fluid over a surface of said turbine blade, and means within said channel for accelerating the flow of cooling fluid prior to said cooling fluid flowing through said at least one exit hole;

said accelerating means comprising a first set of internal features position within said channel and said first set of internal features being shaped and positioned relative to each other so as to create a first flow acceleration zone;

said first set of internal features creating a region for maintaining cooling flow velocity; and said first set of internal features creating a region which takes advantage of pumping effects created by rotation of said turbine engine component, wherein said first set of internal features comprises a pair of dog-legged internal features.

* * * * *